US007847172B2

(12) United States Patent
Harrison

(10) Patent No.: US 7,847,172 B2
(45) Date of Patent: Dec. 7, 2010

(54) HARMONICA

(76) Inventor: Bradley A. Harrison, 3501 N. Southport, #123, Chicago, IL (US) 60657

( * ) Notice: Subject to any disclaimer, the term of this patent is extended or adjusted under 35 U.S.C. 154(b) by 0 days.

(21) Appl. No.: 12/139,825

(22) Filed: Jun. 16, 2008

(65) Prior Publication Data

US 2009/0308223 A1 Dec. 17, 2009

(51) Int. Cl.
*G10D 7/12* (2006.01)

(52) U.S. Cl. ..... 84/377
(58) Field of Classification Search ..... 84/377–379
See application file for complete search history.

(56) References Cited

U.S. PATENT DOCUMENTS

| | | | | |
|---|---|---|---|---|
| 2,595,382 | A * | 5/1952 | Hugin | 84/377 |
| 5,739,446 | A * | 4/1998 | Bahnson | 84/377 |
| 6,291,751 | B1 * | 9/2001 | Antaki | 84/377 |

* cited by examiner

*Primary Examiner*—Kimberly R Lockett
(74) *Attorney, Agent, or Firm*—Leydig, Voit & Mayer, Ltd.

(57) ABSTRACT

The harmonica may include a cover, a comb, reed plates and reeds. In one embodiment, the harmonica may include an upper button and/or a lower button which may allow the cover to be removed from the comb. In another embodiment, the harmonica may include one or more side buttons which allow the cover to be removed from the comb. In another embodiment, the cover may be allowed to pivot relative to the comb so that the cover can be rotated away from the comb. In another embodiment, the harmonica may include one or more inserts and openings in the comb in order to improve the sound of the harmonica. In another embodiment, the harmonica may include one or more side vents which allow air to escape or to enter the harmonica which may improve the sound of the harmonica.

20 Claims, 27 Drawing Sheets

HARMONICA

BACKGROUND

Harmonicas have been used for many years. If a user wishes to clean the inside of the harmonica or to repair one of the reeds, the user would need to remove the fasteners, such as, screws, nails or rivets, which attach the cover to the comb. In addition, users may be interested in obtaining better sound from the harmonica. Also, users may be interested in a harmonica which is more durable. Furthermore, users may be interested in a harmonica which has a shape and configuration which has a better appearance and which is more comfortable to use.

BRIEF SUMMARY

The harmonica may include a cover, a comb, reed plates and reeds. In one embodiment, the harmonica may include an upper button and/or a lower button which may allow the cover to be removed from the comb. In another embodiment, the harmonica may include one or more side buttons which allow the cover to be removed from the comb. In another embodiment, the cover may be allowed to pivot relative to the comb so that the cover can be rotated away from the comb. In another embodiment, the harmonica may include one or more inserts and openings in the comb in order to improve the sound of the harmonica. In another embodiment, the harmonica may include one or more side vents which allow air to escape or to enter the harmonica which may improve the sound of the harmonica. The harmonica may include an upper gripping surface and/or a lower gripping surface. The harmonica may include support features to reduce the possibility of the harmonica becoming deformed or broken. The harmonica may include one or more rounded surfaces which may provide a better appearance and may be more comfortable to use.

DESCRIPTION

Figure 1:
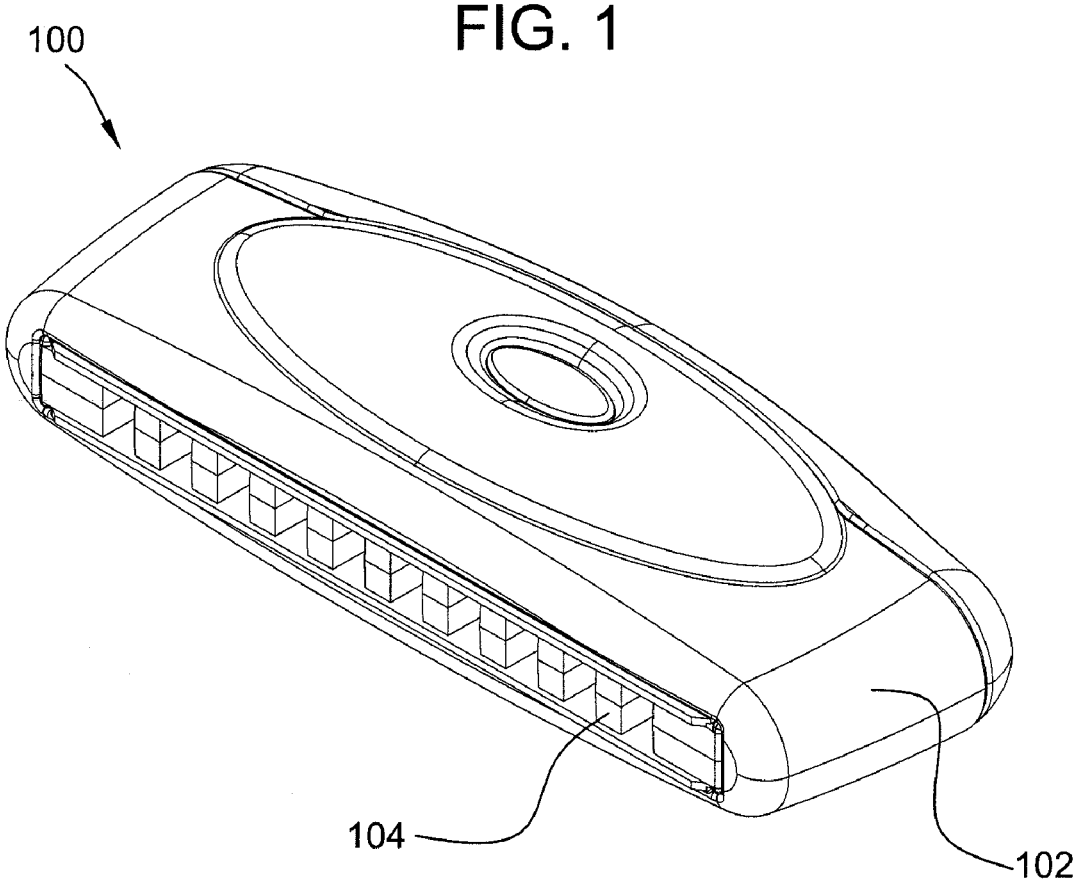
FIG. 1 is a perspective view of a harmonica.
Figure 2:
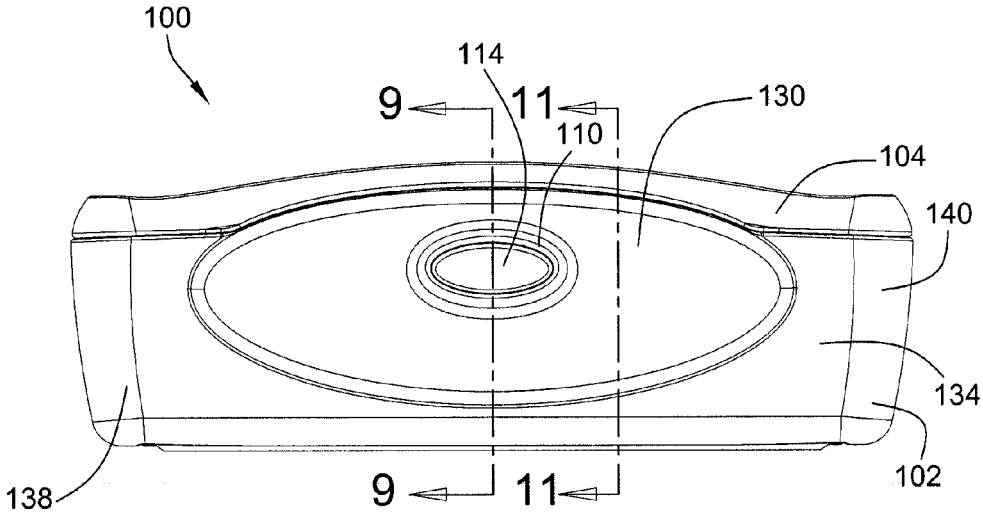
FIG. 2 is a top view of a harmonica.
Figure 3:
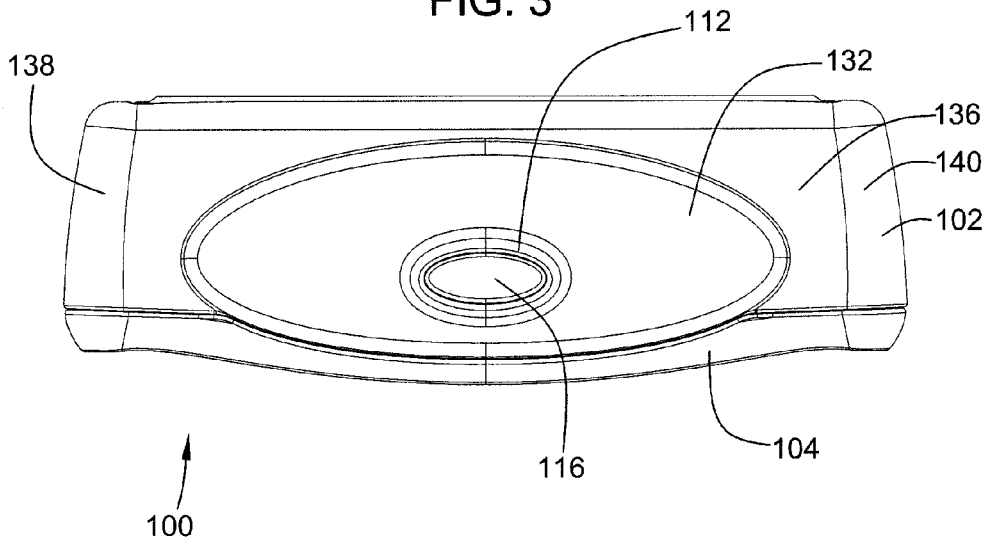
FIG. 3 is a bottom view of a harmonica.
Figure 4:
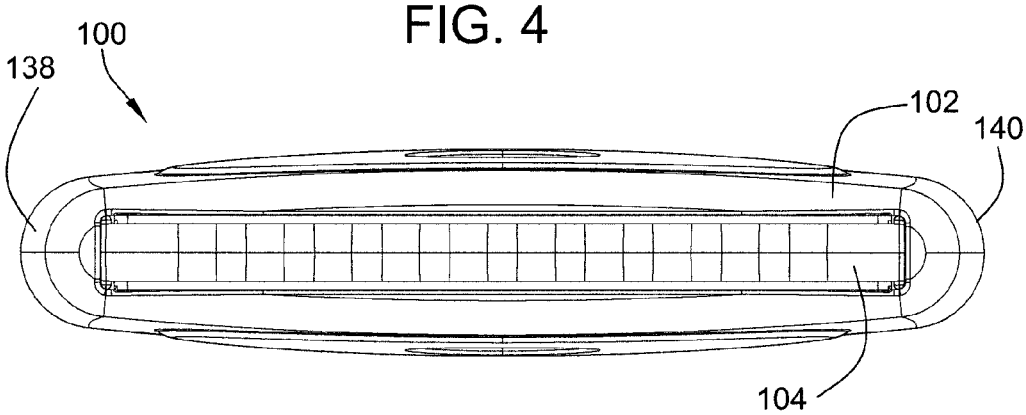
FIG. 4 is a front view of a harmonica.
Figure 8:
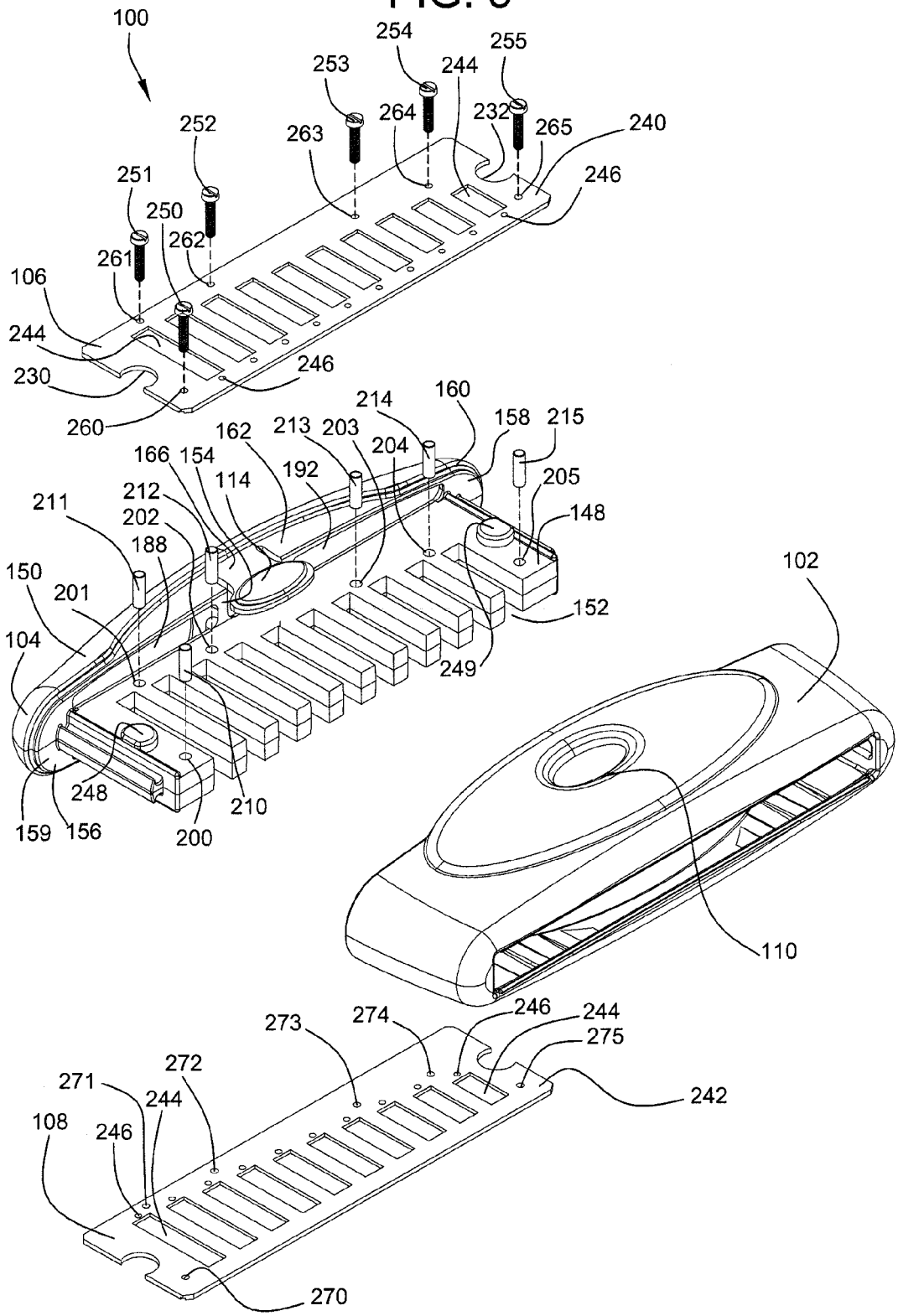
FIG. 8 is an exploded view of a harmonica.
Figure 9:
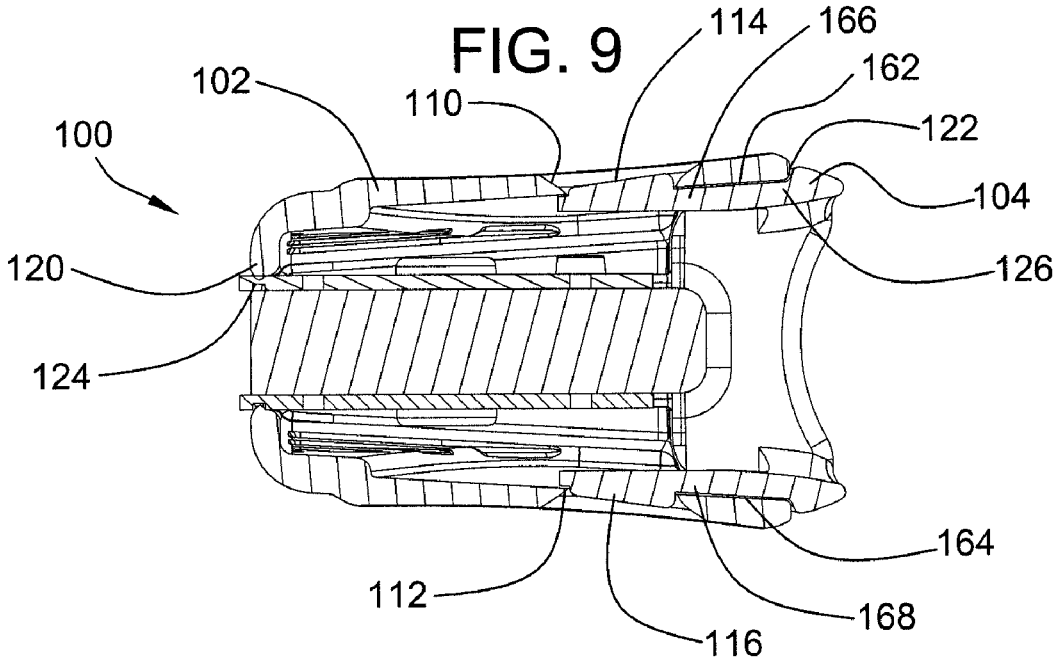
FIG. 9 is a cross-sectional view taken along line 9-9 in FIG. 2.
Figure 10:
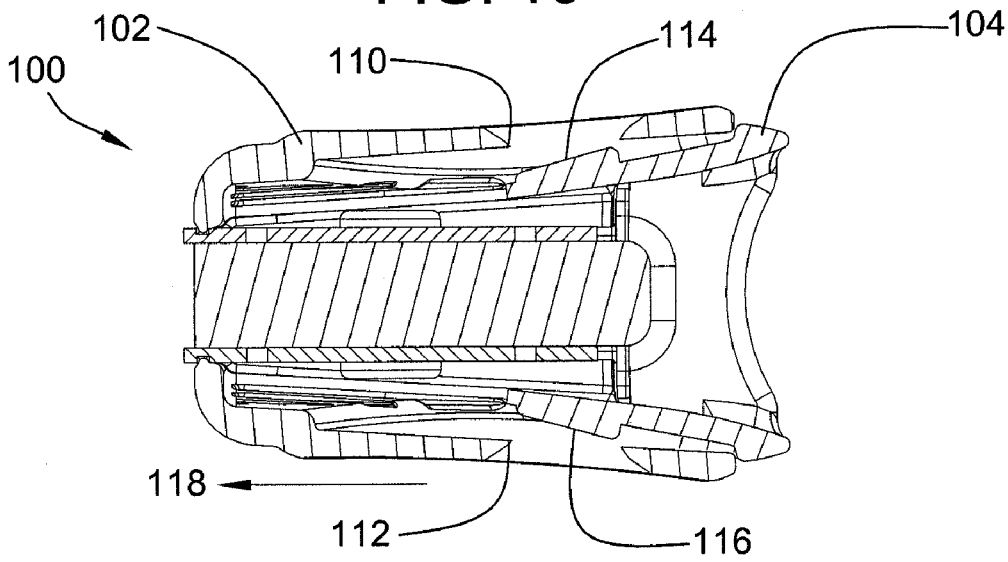
FIG. 10 is a cross-sectional view similar to FIG. 9 with the buttons depressed.

Referring to FIGS. 1 and 8, the harmonica 100 may include a cover 102, a comb 104, an upper reed plate 106 and a bottom reed plate 108. Referring to FIGS. 2, 3 and 8, the cover 102 may include an upper opening 110 and a lower opening 112. The comb 104 may include an upper button 114 and a lower button 116 which engage the upper opening 110 and the lower opening 112, respectively. As shown in FIG. 8, the cover 102 is removable from the comb 104 by sliding the cover 102 away from the comb 104. Referring to FIG. 9, the buttons 114, 116 engage the openings 110, 112. In order to remove the cover 102 from the comb 104, the user would depress the buttons 114, 116 as shown in FIG. 10 and slide the cover 102 in direction 118 away from the comb 104.

Referring to FIG. 9, the cover 102 may include a front opening 120 and a rear opening 122. The front opening 120 may engage the front end 124 of the comb 104. The rear opening 122 may engage the rear end 126 of the comb 104. The cover may be made as one piece or the cover may be made of two or more pieces which may be connected together.

Figure 6:
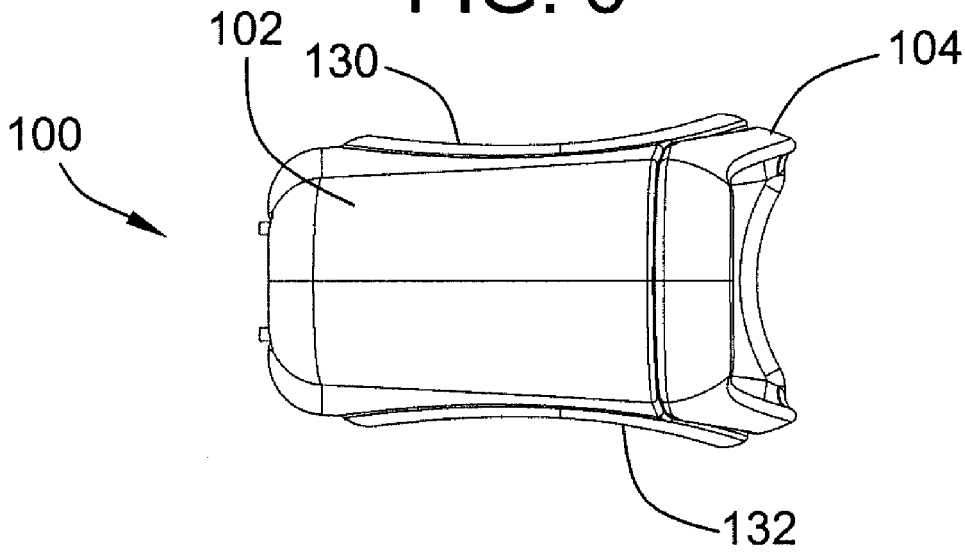
FIG. 6 is a right side view of a harmonica.
Figure 7:
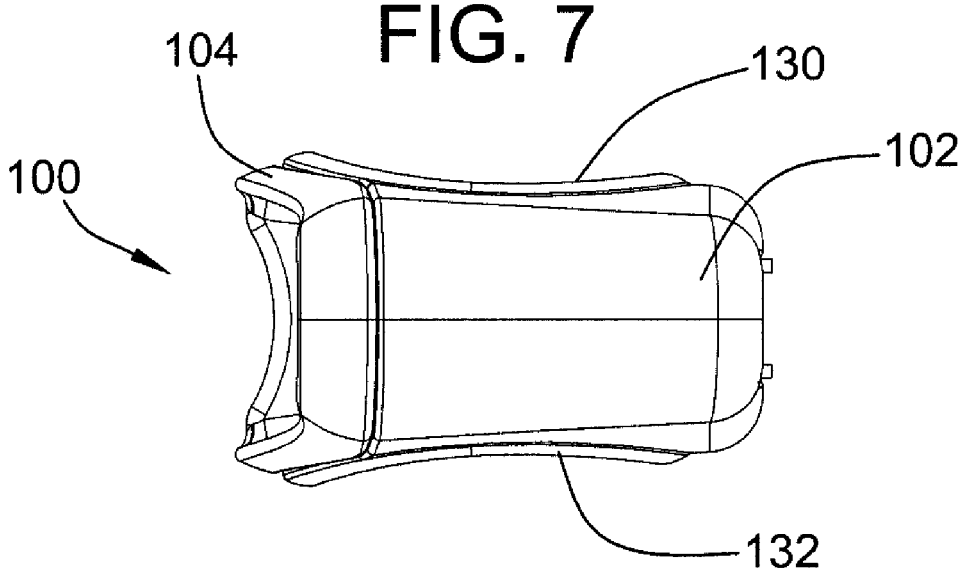
FIG. 7 is a left side view of a harmonica.
Figure 41:
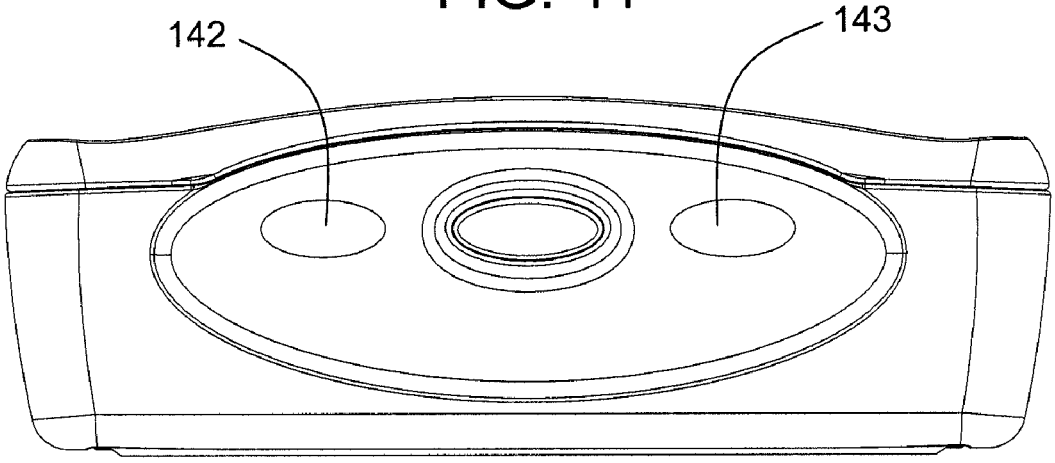
FIG. 41 is a top view of another embodiment of a harmonica.
Figure 42:
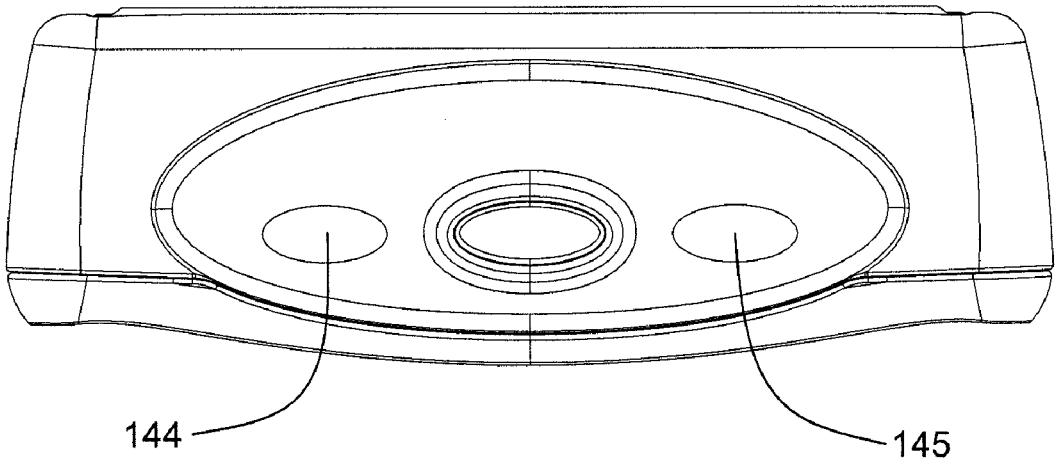
FIG. 42 is a bottom view of a harmonica.

Referring to FIGS. 2 and 3, the cover 102 may include an upper gripping surface 130 and a lower gripping surface 132. The gripping surface may help the user to grip the harmonica. The gripping surfaces 130, 132 may be raised from the adjacent surfaces 134, 136 of the cover 102. The gripping surfaces 130, 132 may be made of the same material as the adjacent surfaces 134, 136 or the gripping surfaces may be made of a different material. For example, the cover may be made of metal, plastic, carbon graphite, graphite and composites. The metal may be steel, aluminum, stainless steel, brass, or other metals. The metal may have a plating, such as, chrome or nickel or other plating, and/or a coating, such as, Teflon or other coating. The plastic may be acrylonitrile butadiene styrene (ABS) or other plastics. The plastic may be a composite and may be glass filled. If the gripping surfaces are a different material, the gripping surfaces may be made of rubber, elastomer, plastic or other material. The gripping surfaces 130, 132 may be oval in shape. In other embodiments, the gripping surfaces may have the following shapes, such as, rectangle, polygon, or circle. Referring to FIGS. 6 and 7, the gripping surfaces may be concave. Referring to FIGS. 41 and 42, the gripping surfaces may include gripping pads 142, 143, 144, 145. Referring to FIGS. 2-5, the cover 102 may have rounded ends 138, 140. The rounded ends 138, 140 may be more comfortable when the user grips the harmonica. In addition, the rounded ends may allow the user to have a more airtight grip on the harmonica which may aid in cupping and notes bending and shaping.

Referring to FIG. 8, the comb 104 may include a front portion 148 and a rear portion 150. The front portion may include slots 152. In this embodiment, the comb 104 has ten slots 152. In other embodiments, the comb may have any number of slots, such as, 3, 5, 10, 12, 14, 16 or 18 slots. The rear portion 150 may be larger than the front portion 148. The rear portion 150 may have an upper wall 154, a lower wall 156, a right side wall 158 and a left side wall 159. The rear portion 150 may include a rim 160. The rim 160 may engage the cover 102. The rim 160 may support the cover 102 and reduce the possibility of the cover 102 becoming deformed or broken if a force was applied to the cover. For example, a force may be applied to the cover when a user places the harmonica in a rear pocket and then sits on the harmonica.

Referring to FIGS. 8 and 9, the rear portion 150 may include an upper surface 162 and a lower surface 164. The upper surface 162 may include an arm 166 which is connected to the button 114. The lower surface 164 may include an arm 168 which is connected to the button 116. The arms 166, 168 may deflect when a force is applied to the buttons 114, 116 so that the cover 102 may be removed as noted herein. In other embodiments, the button may be located on the cover and the comb may have an opening or a latch.

Figure 5:
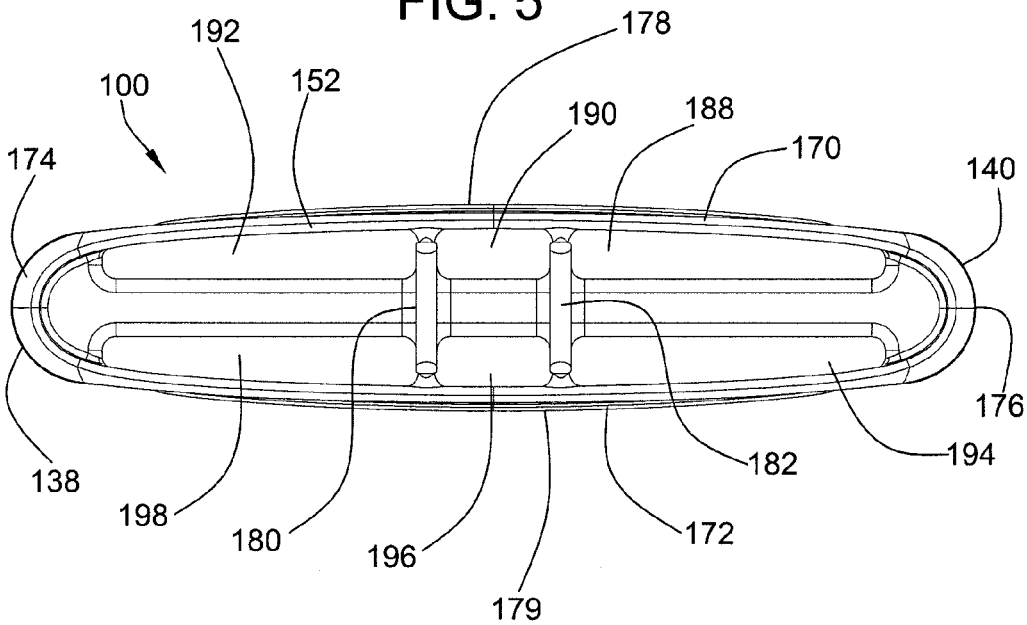
FIG. 5 is a rear view of a harmonica.
Figure 11:
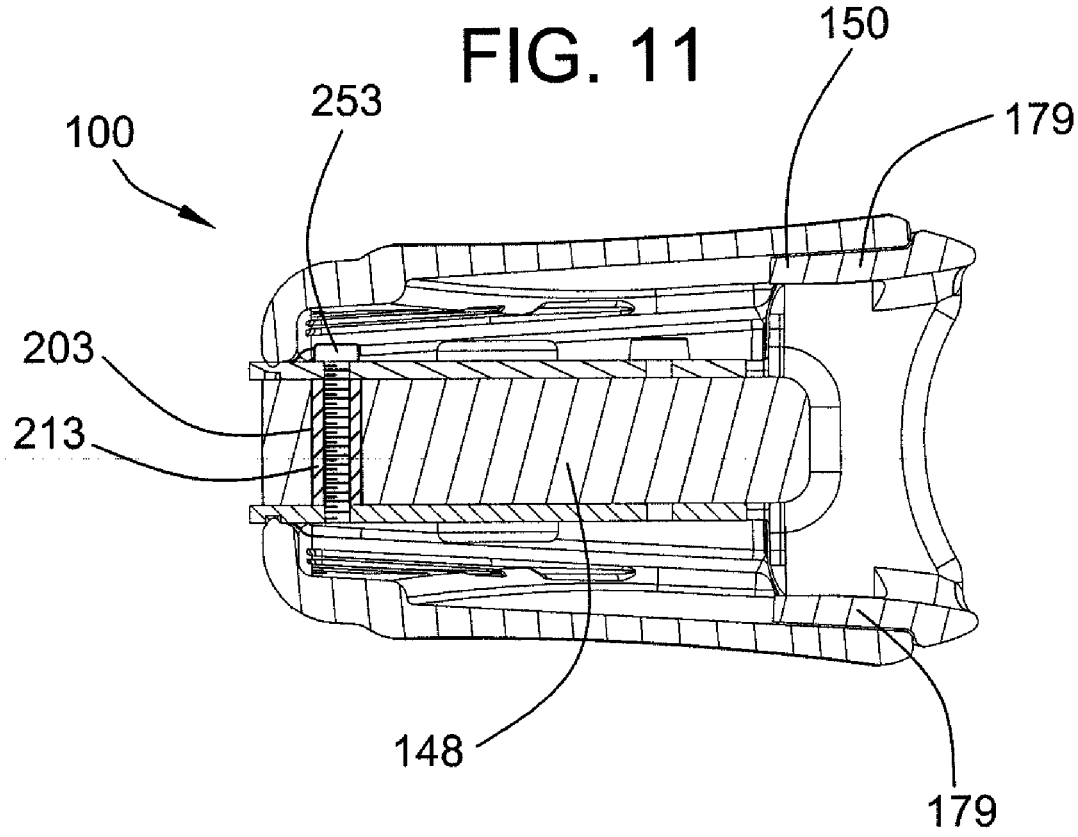
FIG. 11 is a cross-sectional view taken along line 11-11 in FIG. 2.

Referring to FIG. 5, the rear portion 150 may include a curved top surface 170, a curved bottom surface 172, a curved right side surface 174 and a curved left side surface 176. Referring to FIG. 11, the rear portion 150 may include an upper wall 178 and a lower wall 179. The upper wall 178 may extend outwards away from the front portion 148. The lower wall 179 may extend outwards away from the front portion 148. Referring to FIG. 5, the rear portion 150 may include supports 180, 182. The supports 180, 182 extend from the upper wall 178 to the lower wall 179. The supports 180, 182 may provide support to the walls 178, 179 and reduce the possibility of the walls from becoming deformed or broken. In other embodiments, the rear portion may include one, three, four or more supports. The supports may be used to remove the cover from the comb. For example, the user may grasp the supports with the thumb and index finger of the left hand and push the buttons with the thumb and index finger of the right hand. In an embodiment, the supports may include gripping pads made of a material, such as, rubber, elastomer, plastic, or other material.

Referring to FIGS. 5 and 8, the upper wall 154 and the lower wall 156 may include openings 188, 190, 192, 194, 196, 198. The openings 188, 190, 192, 194, 196, 198 may allow the air to escape or to enter the harmonica when the user is playing the harmonica. In other embodiments, the walls may include more or less openings as appropriate.

Referring to FIG. 8, the front portion 148 may include openings 200, 201, 202, 203, 204, 205. The openings 200, 201, 202, 203, 204, 205 may include inserts 210, 211, 212, 213, 214, 215. The inserts may have a tubular shape. The inserts may be located in the openings. Referring to FIG. 11, the insert 213 is located in the opening 203 and screw 253 extends through the insert 213. In some embodiments, the openings may have inserts, but no screws through the inserts. The inserts may have a friction fit with the openings. The inserts may improve the sound and volume of the harmonica. It is believed that the inserts may transfer the sound vibrations from the reed to the reed plate, from the reed plate to the insert, from the insert to the comb, from the comb to the cover.

Referring to FIG. 8, the harmonica 100 may include an upper reed plate 240 and a lower reed plate 242. The reed plates 240, 242 may include reeds 244. The reeds 244 may be attached to the reed plates with rivets 246. In other embodiments, the reeds may be attached with spot welds, screws, or screws with nuts. The reeds 244 vibrate to create sound. The comb 104 may include protrusions 248, 249 which may align with openings 230, 232 in the reed plates in order to position the reed plates. The reeds 244 may be aligned with the slots 152 in the comb. The reed plates 240, 242 may be attached to the comb 104 with screws 250, 251, 252, 253, 254, 255. The screws may be inserted through holes 260, 261, 262, 263, 264, 265 in the reed plate 240 and the openings 200, 201, 202, 203, 204, 205 in the comb. If the openings include inserts, then the screws may be inserted through the inserts. The screws may engage threaded holes 270, 271, 272, 273, 274, 275 in the reed plate 242. In other embodiments, the screws may be inserted through holes in the reed plate 242 and then the screws may engage nuts. In other embodiments, the reed plates may be attached with one, two, three, four, six or more screws, as appropriate. In other embodiments, the reed plates may be attached with rivets or nails.

The comb may be made of wood, metal, plastic, carbon graphite, graphite and composites. The metal may be steel, aluminum, stainless steel, brass, or other metals. The metal may have a plating, such as, chrome or nickel or other plating, and/or a coating, such as, Teflon or other coating. The plastic may be acrylonitrile butadiene styrene (ABS) or other plastics. The plastic may be a composite and may be glass filled. The inserts may be made of metal, such as, brass, steel, aluminum, or other metal. The reed plates and reeds may be made of metal, such as, brass or steel.

Figure 12:
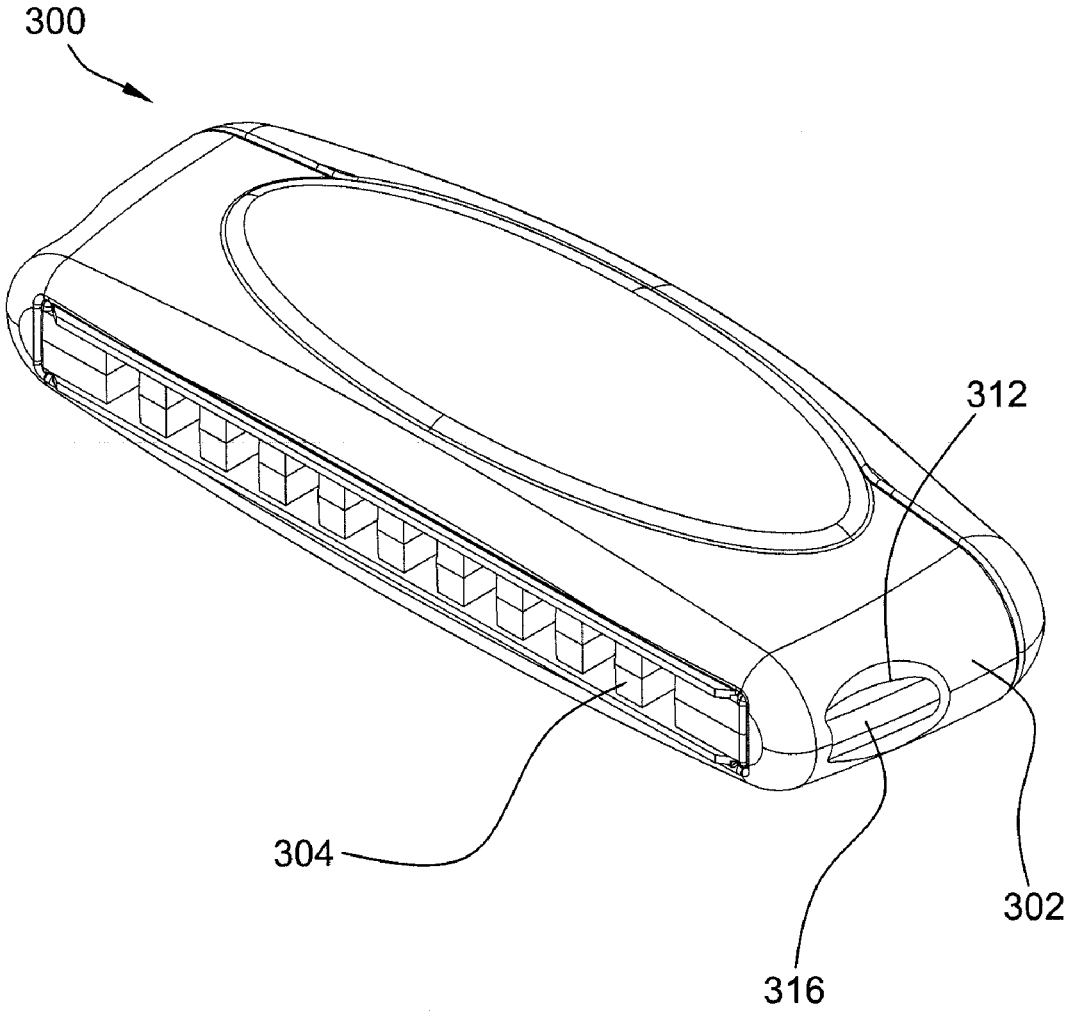
FIG. 12 is a perspective view of another embodiment of a harmonica.
Figure 13:
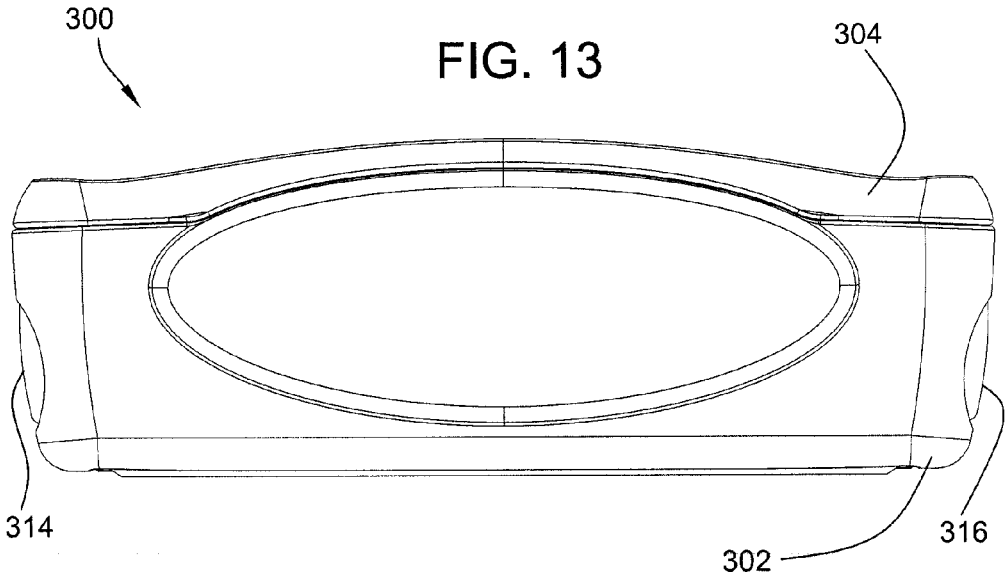
FIG. 13 is a top view of a harmonica.
Figure 14:
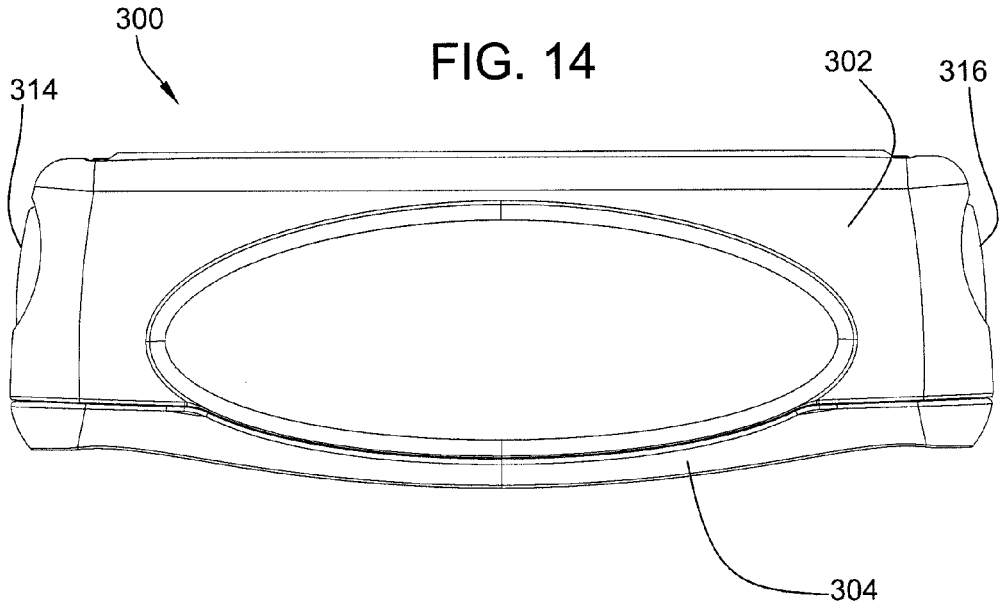
FIG. 14 is a bottom view of a harmonica.
Figure 15:
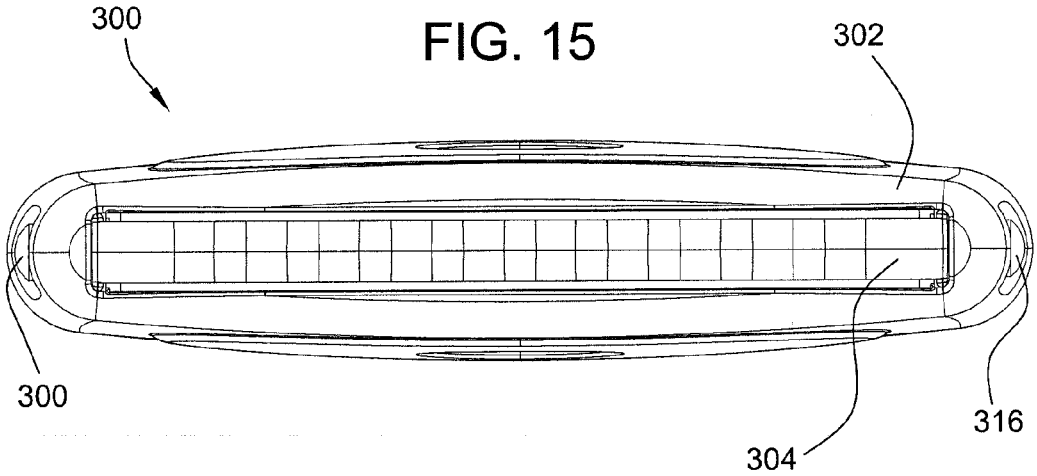
FIG. 15 is a front view of a harmonica.
Figure 16:
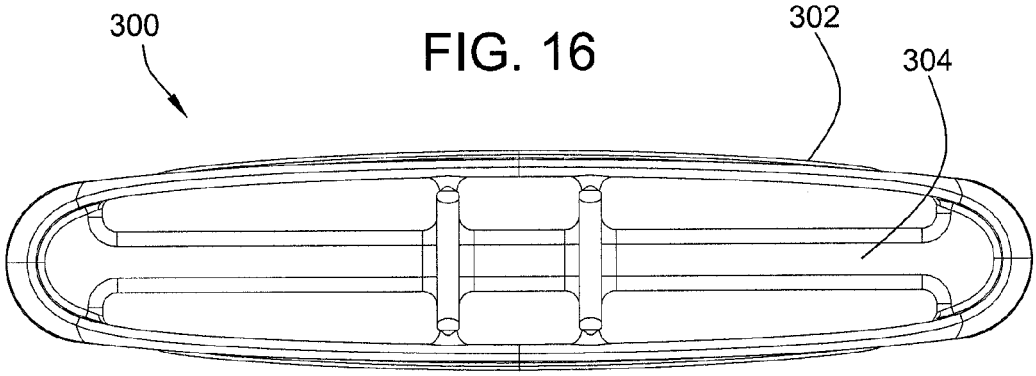
FIG. 16 is a rear view of a harmonica.
Figure 17:
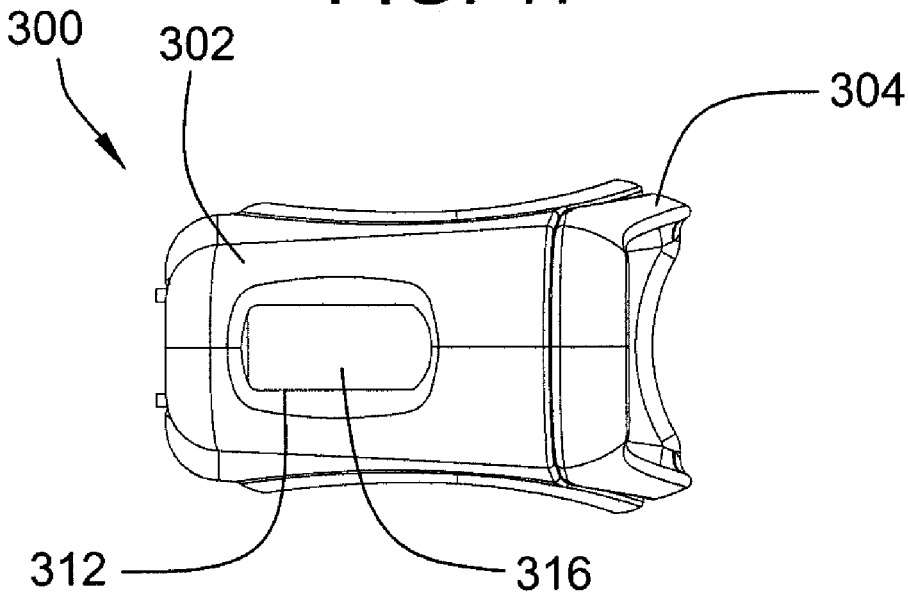
FIG. 17 is a right side view of a harmonica.
Figure 18:
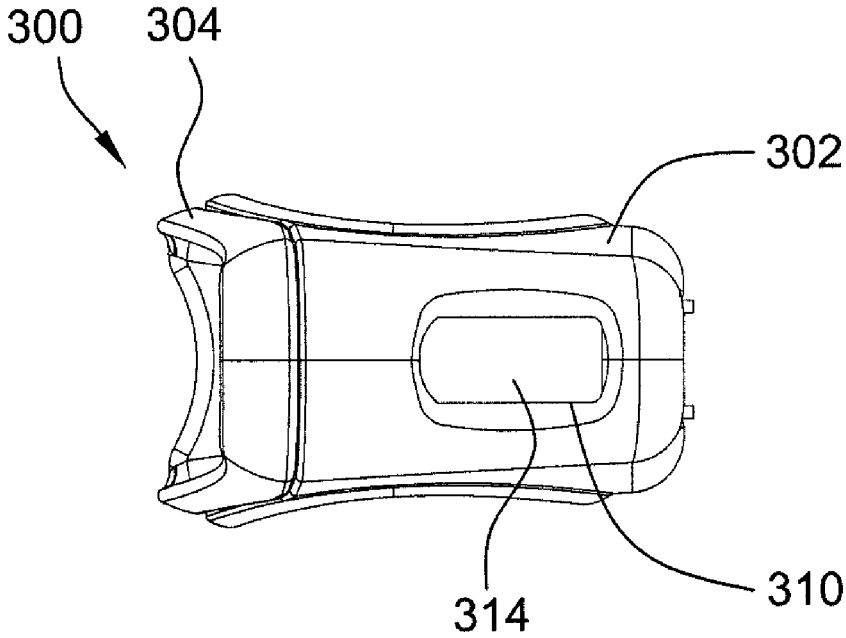
FIG. 18 is a left side view of a harmonica.
Figure 19:
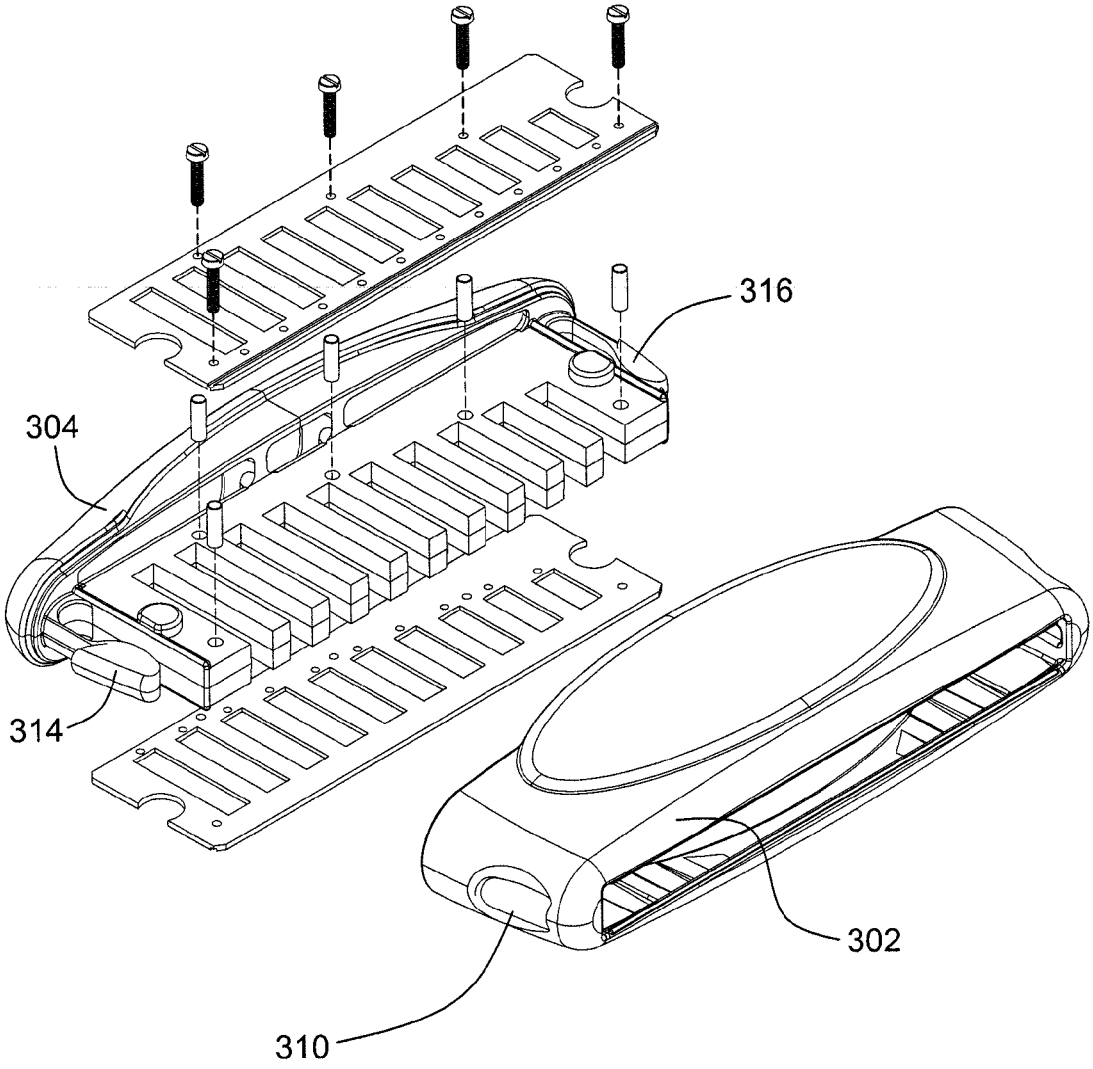
FIG. 19 is an exploded view of a harmonica.
Figure 20:
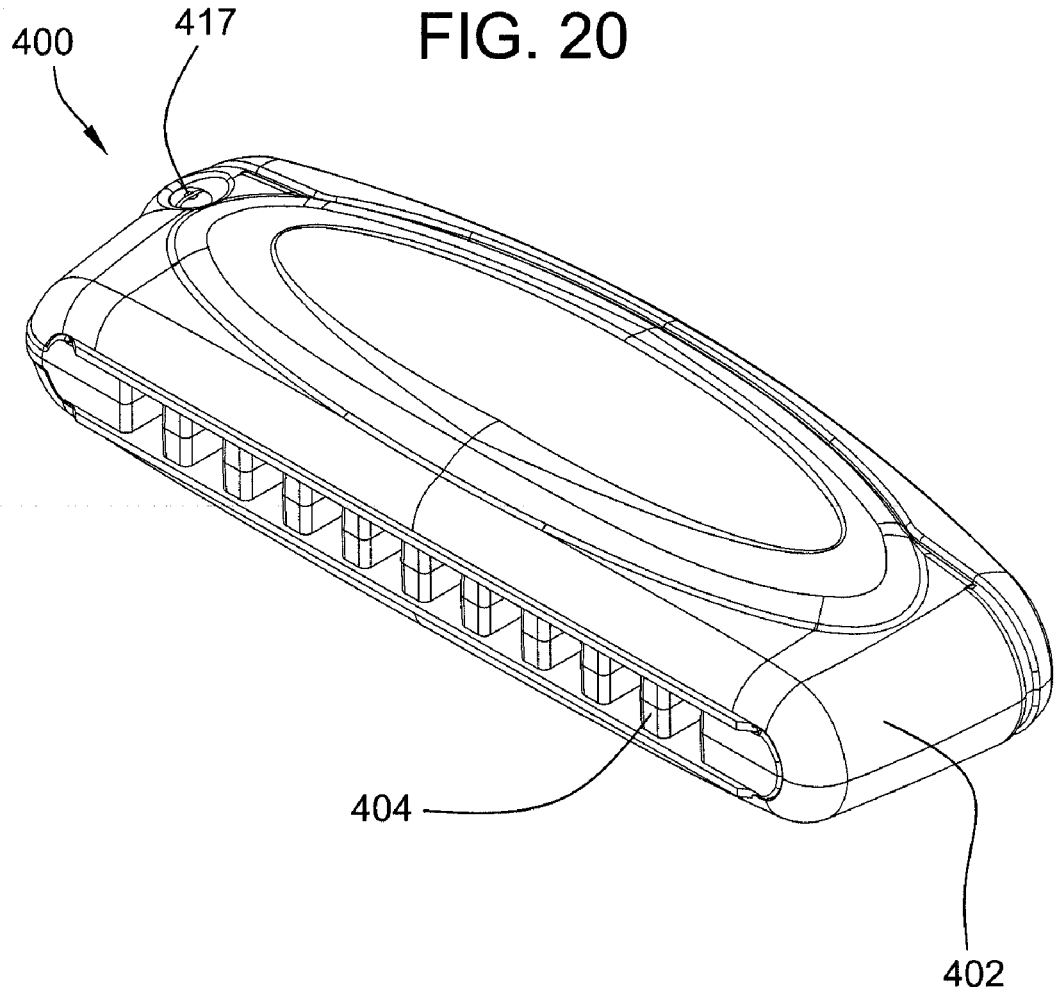
FIG. 20 is a perspective view of another embodiment of a harmonica.

Another embodiment of the harmonica is shown in FIGS. 12-19. The harmonica 300 is similar to the harmonica 100, but the harmonica 300 uses side buttons to attach the cover to the comb. Referring to FIGS. 12 and 19, the comb 304 may include side buttons 314, 316. The cover 302 may include openings 310, 312 to engage the buttons 314, 316. The user may depress the side buttons 314, 316 in order to remove the cover 302 from the comb 304.

Figure 21:
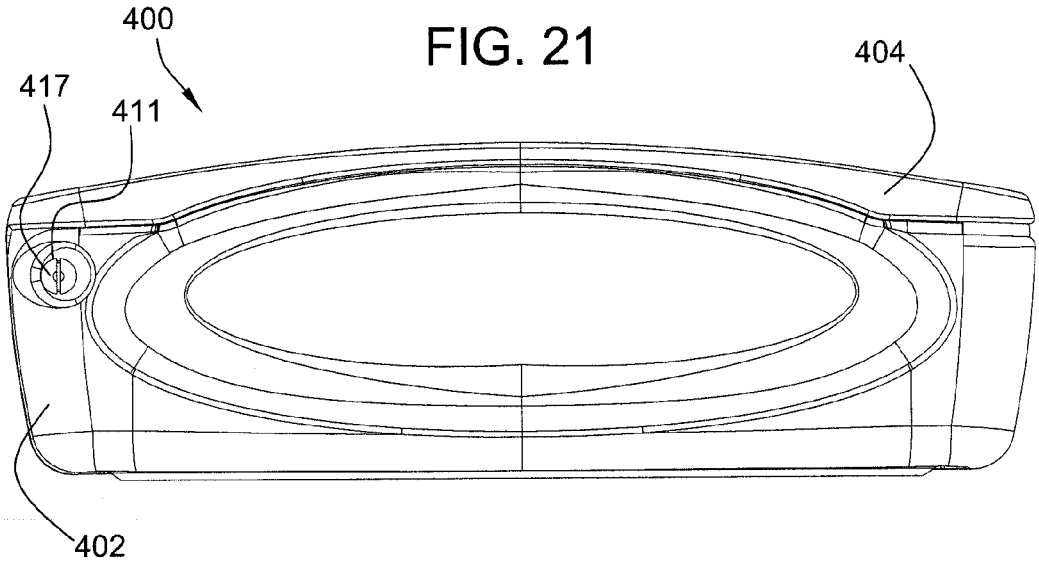
FIG. 21 is a top view of a harmonica.
Figure 22:
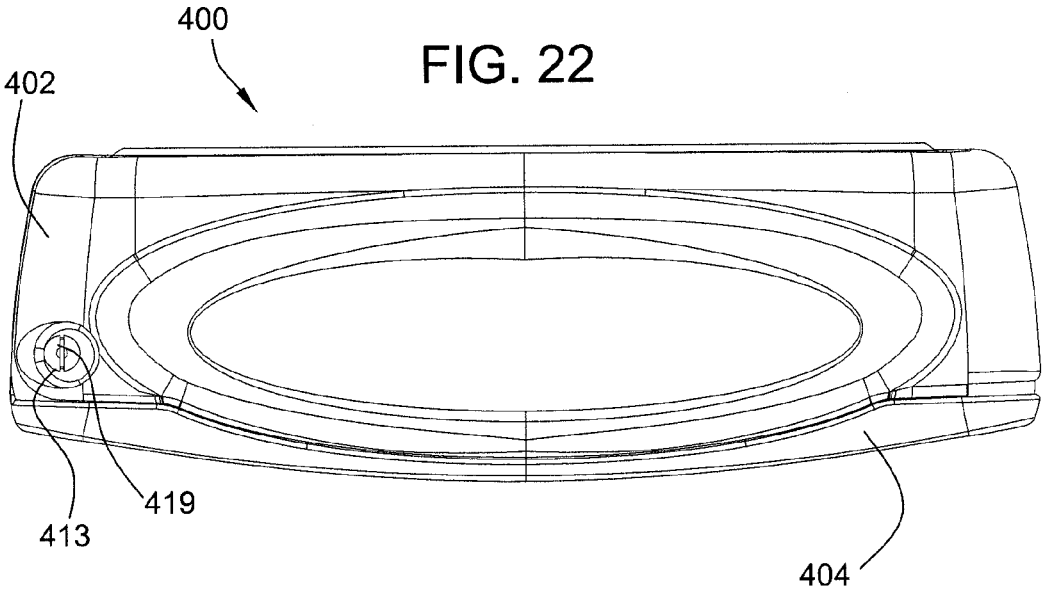
FIG. 22 is a bottom view of a harmonica.
Figure 23:
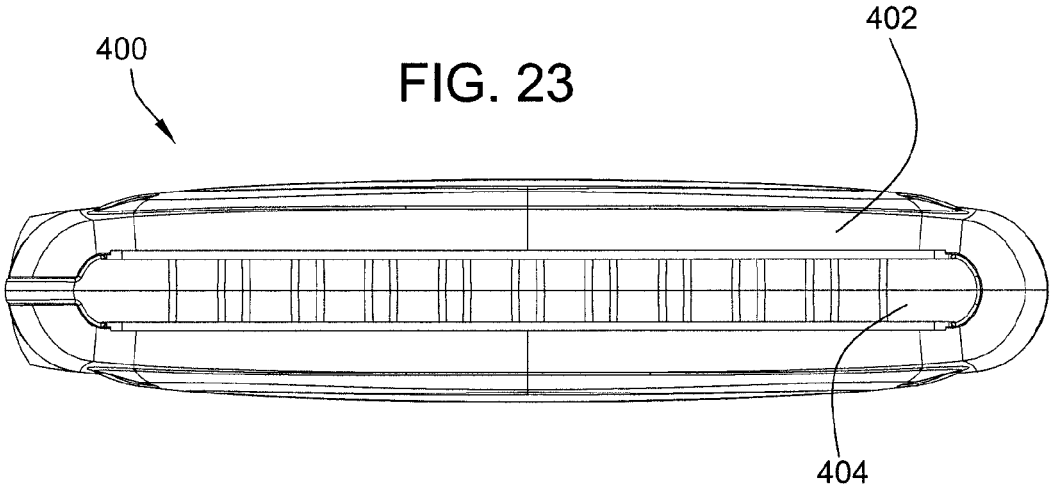
FIG. 23 is a front view of a harmonica.
Figure 24:
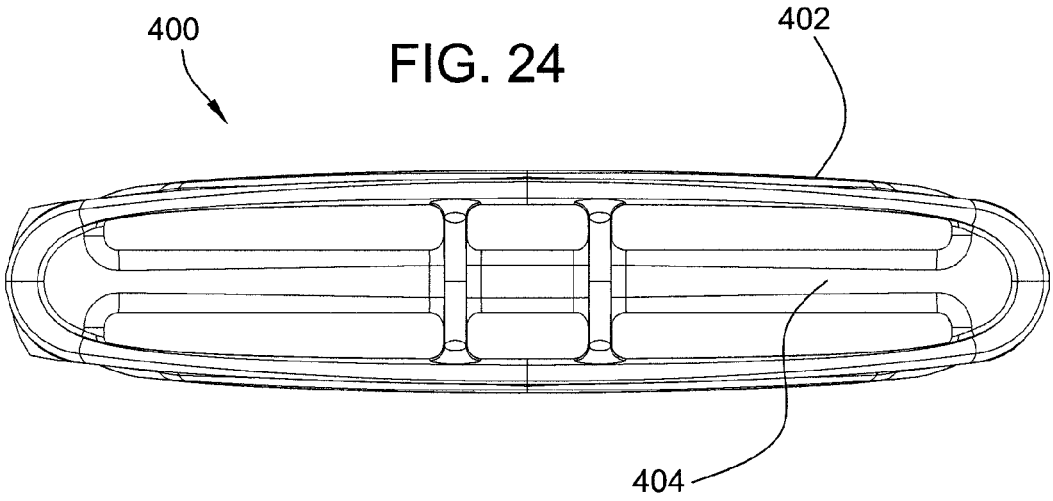
FIG. 24 is a rear view of a harmonica.
Figure 25:
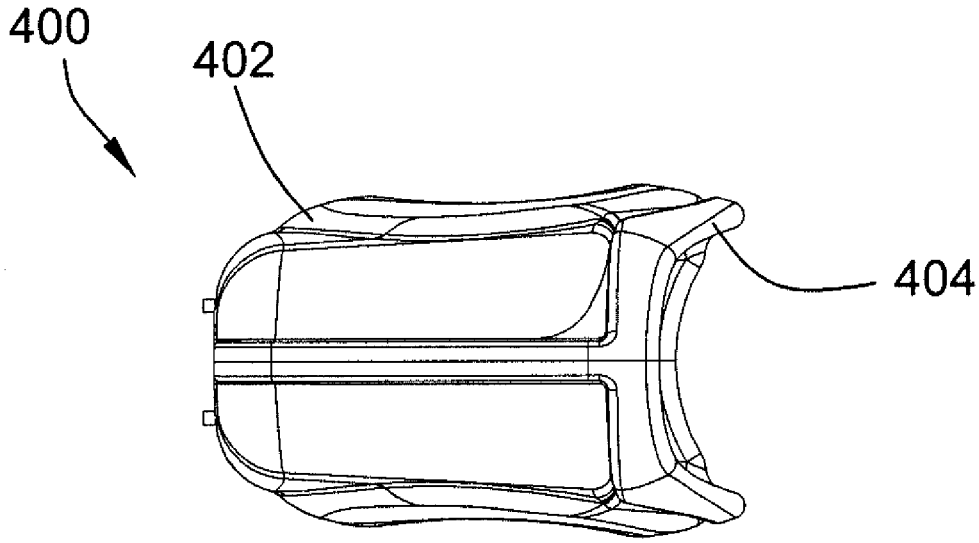
FIG. 25 is a right side view of a harmonica.
Figure 26:
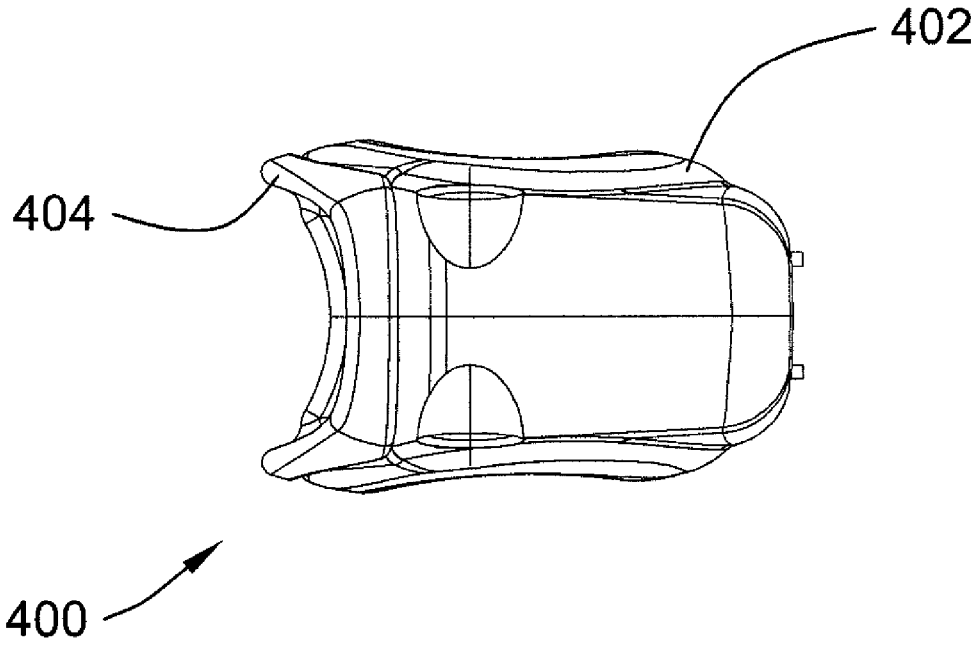
FIG. 26 is a left side view of a harmonica.
Figure 27:
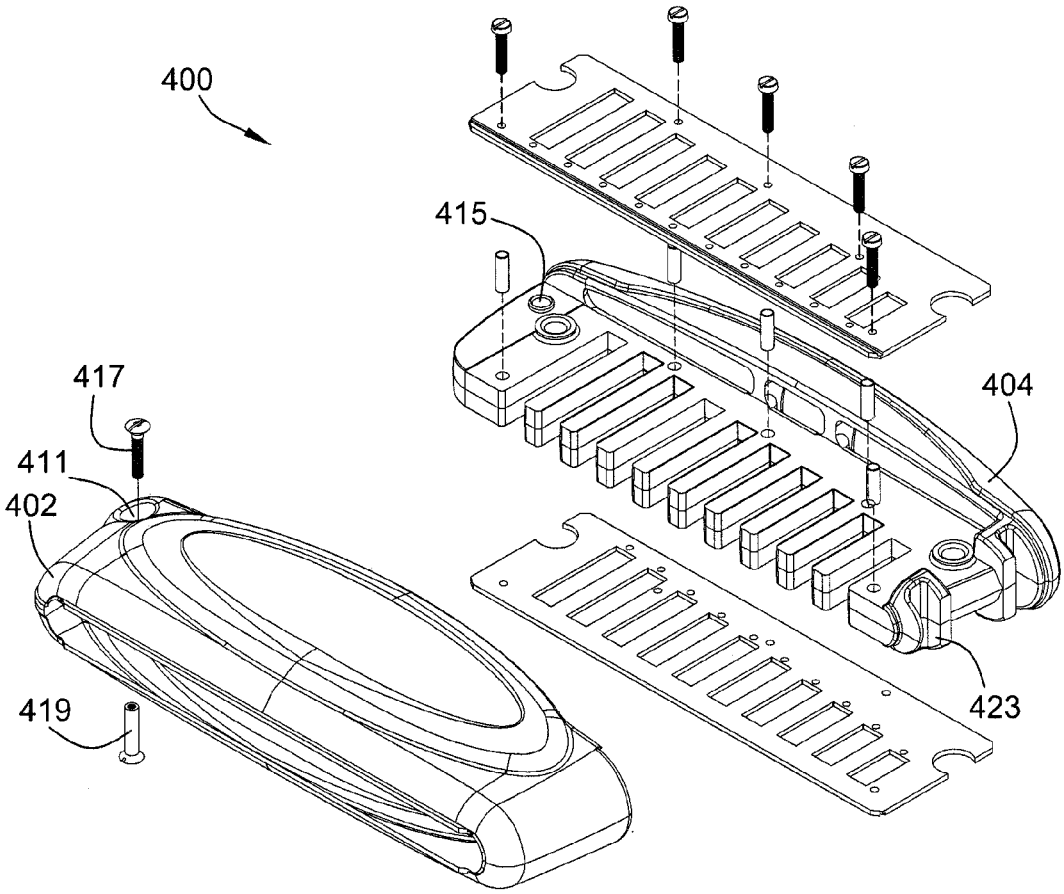
FIG. 27 is an exploded view of a harmonica.
Figure 28:
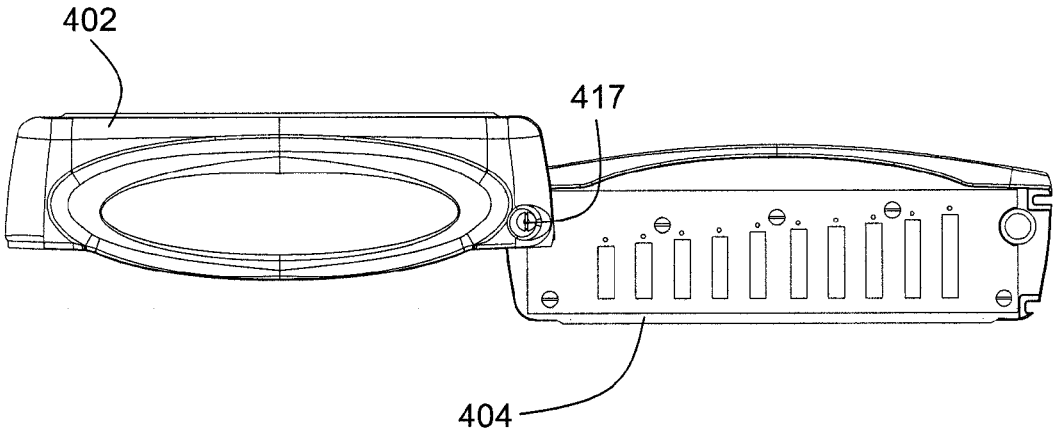
FIG. 28 is a perspective view of a harmonica in the open position.

Another embodiment of the harmonica is shown in FIGS. 20-28. The harmonica 400 is similar to the harmonica 100, but the harmonica 400 may include a pivot and a latch to attach the cover to the comb. Referring to FIGS. 21, 22 and 27, the cover 402 may include openings 411, 413 and the comb 404 may include an opening 415. A screw 417 may be inserted through the openings and the screw 417 may engage a nut 419. In other embodiments, the screw may engage a threaded opening in the cover or the comb, and a nut may not be necessary. In order to gain access to the comb, the cover may rotate relative to the comb along a pivot point. Referring to FIG. 28, the cover 402 may rotate relative to the comb 404 on the screw 417. Thus, the user can open the harmonica by rotating the cover 402 relative to the comb 404 in order to clean the harmonica or to repair the reeds. After the user has finished the cleaning or the repairs, the user can close the harmonica by rotating the cover 402 relative to the comb 404. The comb and/or the cover may include a latch mechanism 421. For example, the comb 404 may include a protrusion 423 which may engage a protrusion on the cover 402 to provide a snap engagement. In other embodiments, the latch mechanism may be a button and opening arrangement, such as, the side button and opening shown in FIG. 12.

Figure 34:
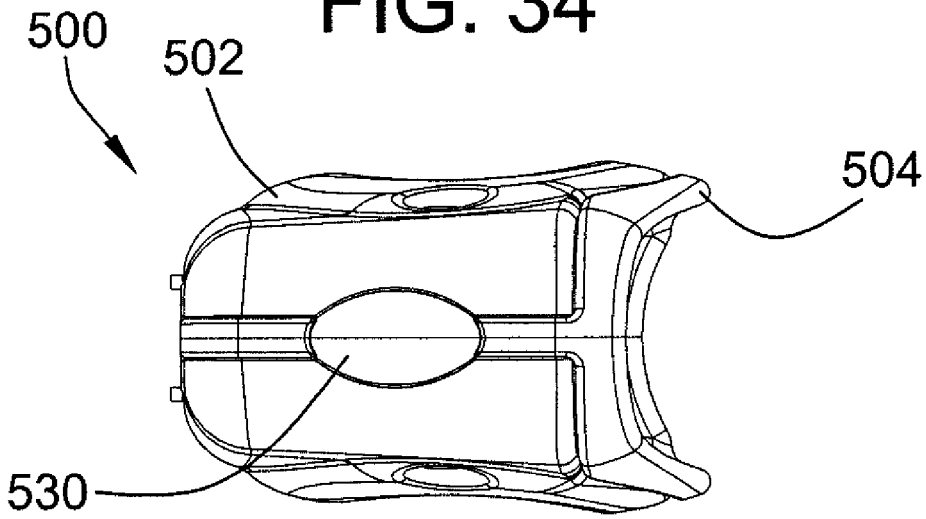
FIG. 34 is a right side view of a harmonica.
Figure 35:
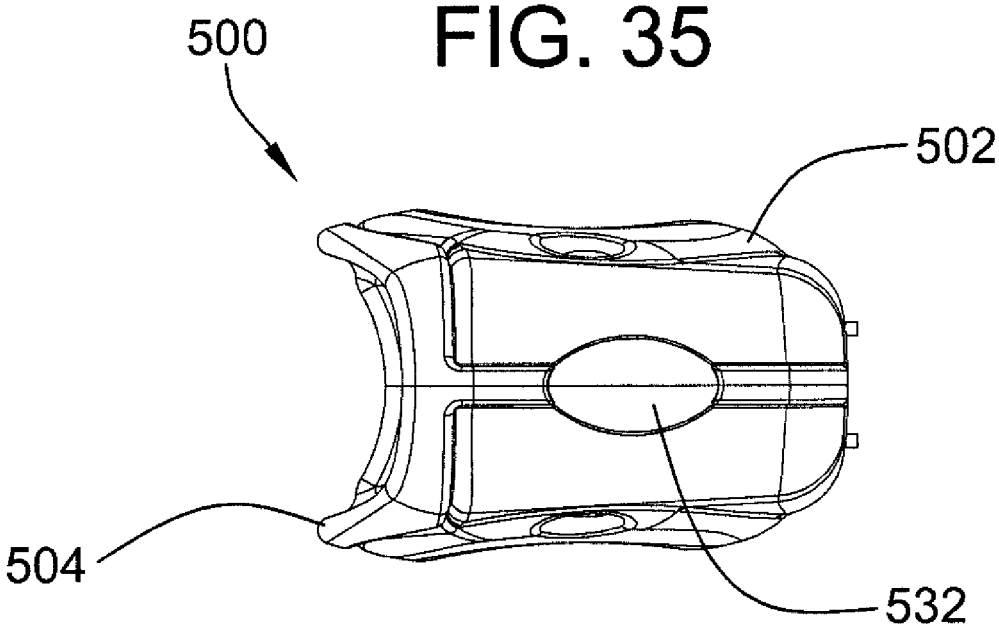
FIG. 35 is a left side view of a harmonica.
Figure 36:
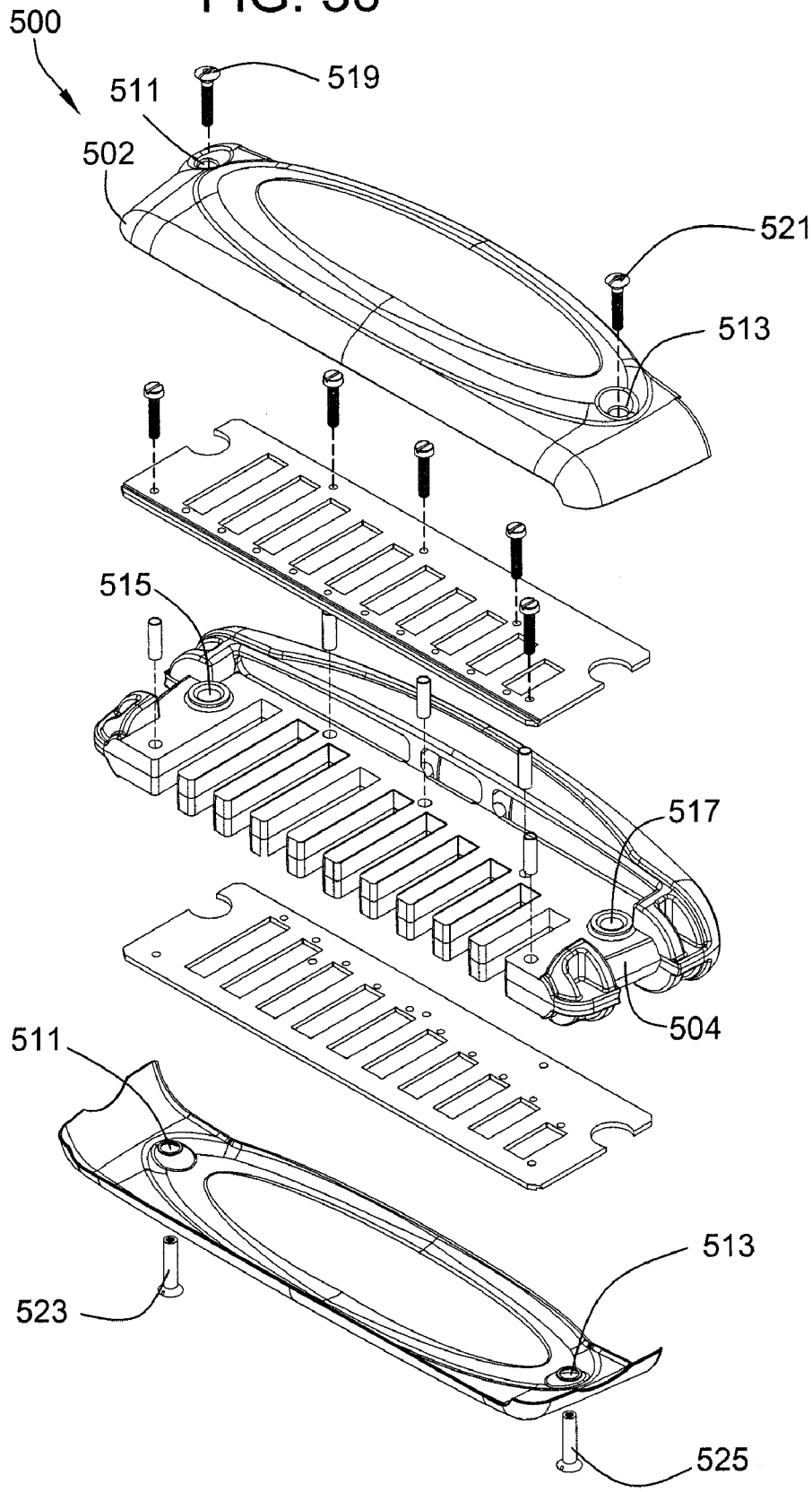
FIG. 36 is an exploded view of a harmonica.
Figure 37:
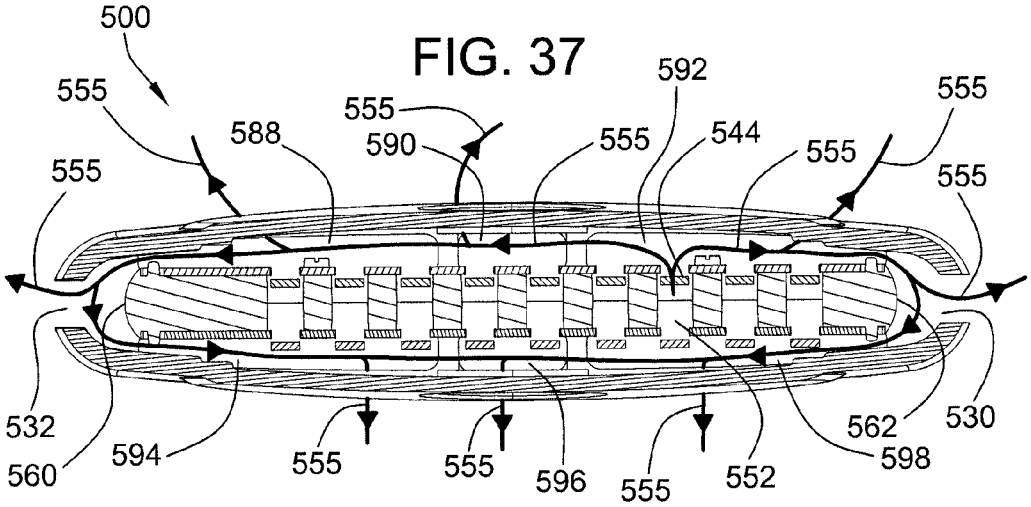
FIG. 37 is a cross-sectional view taken along line 37-37 of FIG. 31 showing the air flow when air is blown into the harmonica.

Another embodiment of the harmonica is shown in FIGS. 29-40. The harmonica 500 is similar to the harmonica 100, but the harmonica 500 may include two fasteners for the covers and side vents for the cover. Referring to FIG. 36, the cover 502 may include openings 511, 513 and the comb 504 may include openings 515, 517. Screws 519, 521 may be inserted through the openings and the screws may engage nuts 523, 525. Thus, the cover may be attached to the comb. In other embodiments, the screws may engage a threaded opening in the bottom cover or the comb, and a nut may not be necessary.

Figure 29:
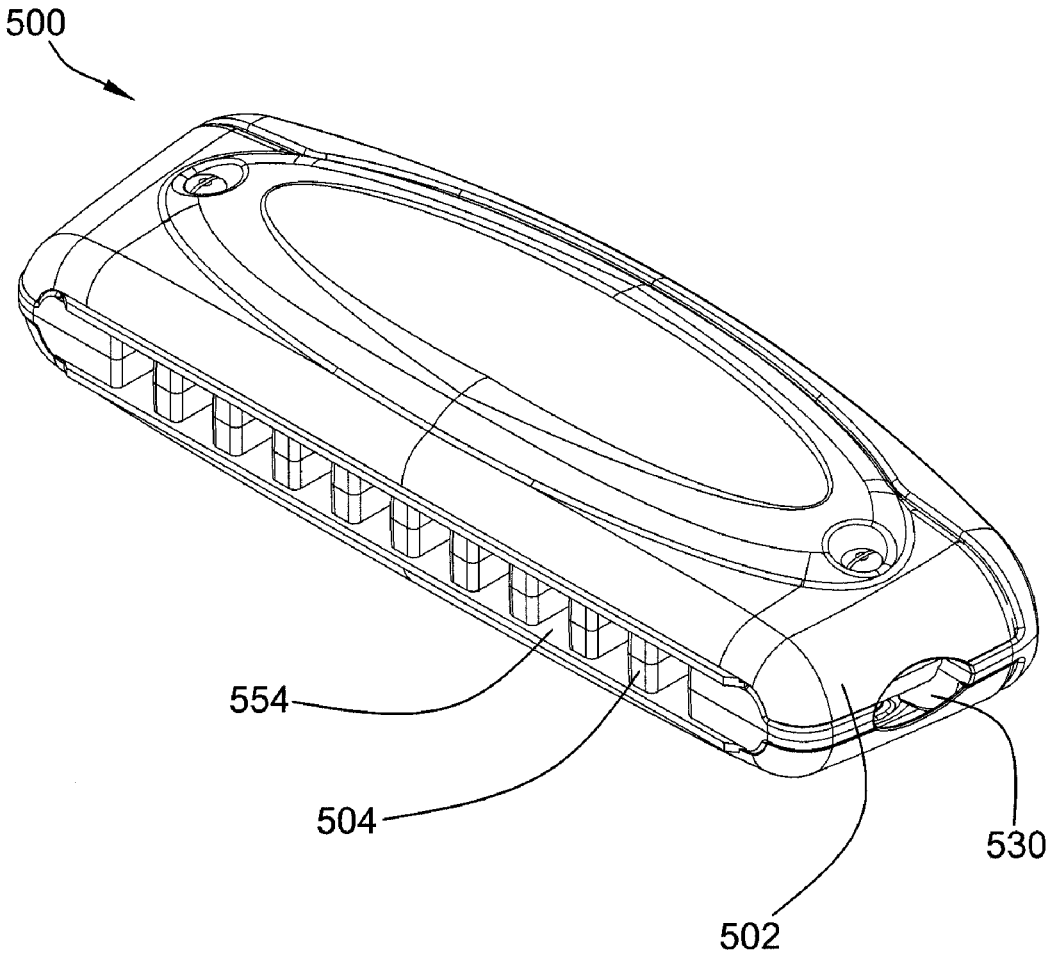
FIG. 29 is a perspective view of another embodiment of a harmonica.
Figure 30:
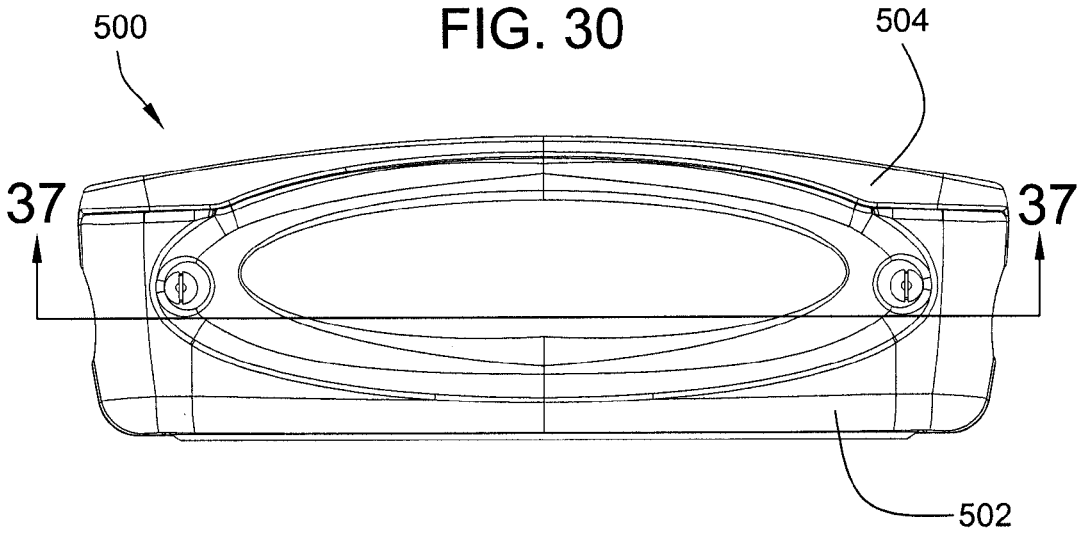
FIG. 30 is a top view of a harmonica.
Figure 31:
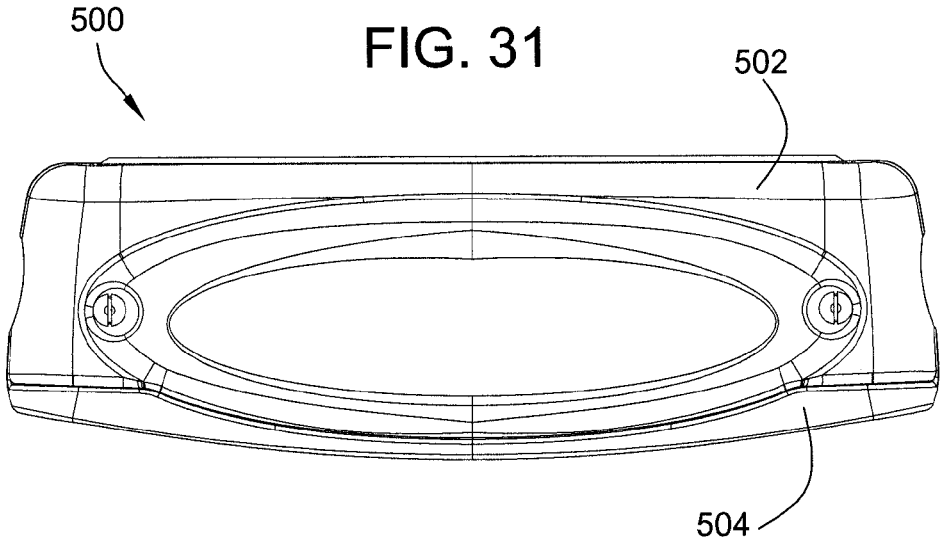
FIG. 31 is a bottom view of a harmonica.
Figure 32:
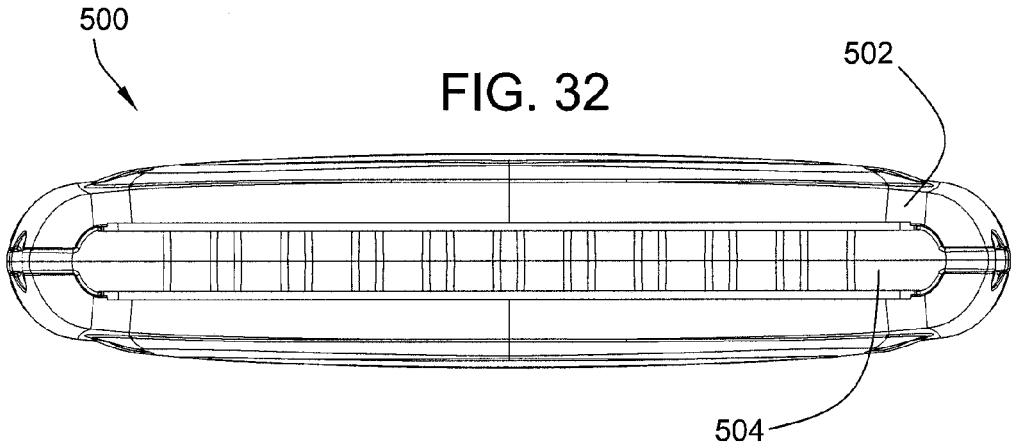
FIG. 32 is a front view of a harmonica.
Figure 33:
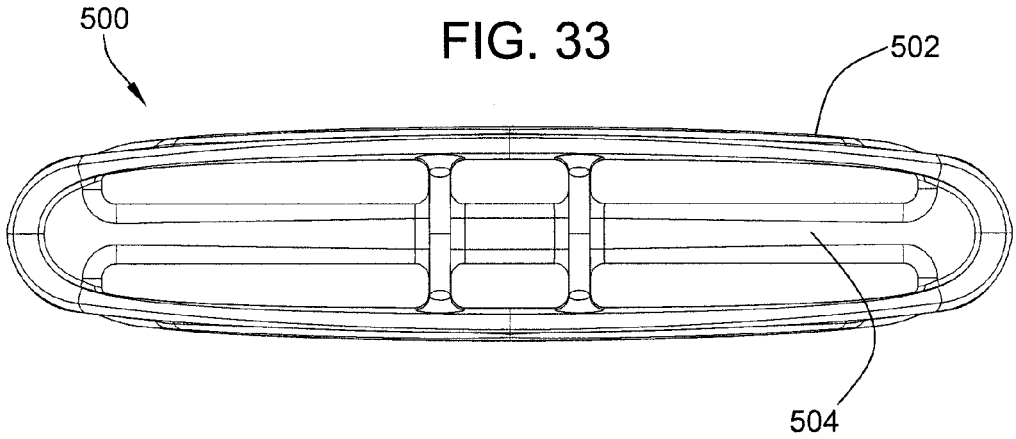
FIG. 33 is a rear view of a harmonica.

Referring to FIGS. 29, 34 and 35, the harmonica 500 may include side vents 530, 532. The side vents 530, 532 may be located in the cover 502 on the left side and/or right side. The side vents allow air to escape or to enter the harmonica when the harmonica is being played. Thus, the side vents may improve the sound of the harmonica. In addition, the user may decide to cover a portion of the side vent or the entire side vent to alter the sound of the harmonica. The side vents 530, 532 may have an oval shape. In other embodiments, the side vents may have the following shapes: rectangle, square, polygon, or circle. In other embodiments, the harmonica may have one vent, three vents, four vents, or more vents. The side vent may be used with the other embodiments described herein as appropriate, such as, the harmonica in FIGS. 1, 12 and 20.

Figure 38:
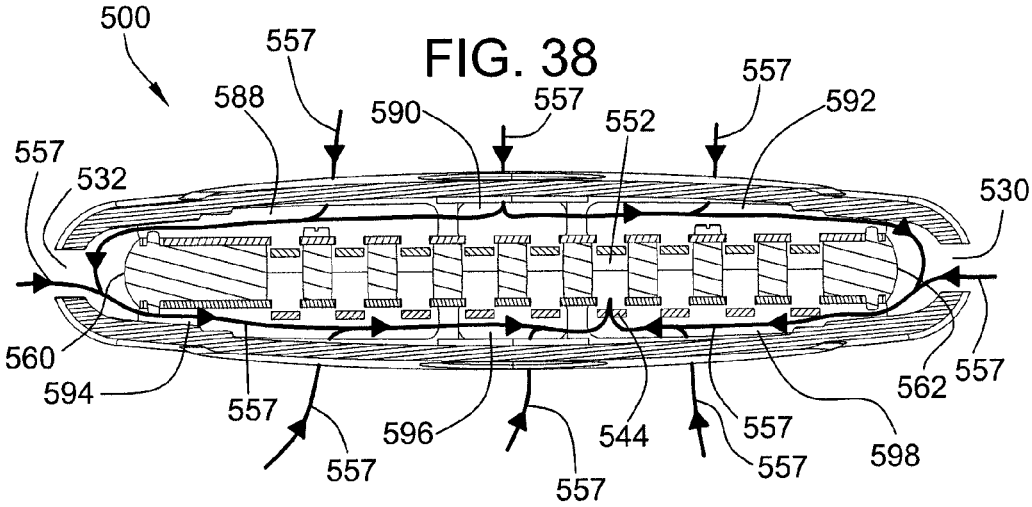
FIG. 38 is a cross-sectional view similar to FIG. 37 showing the air flow when air is drawn into the harmonica.
Figure 39:
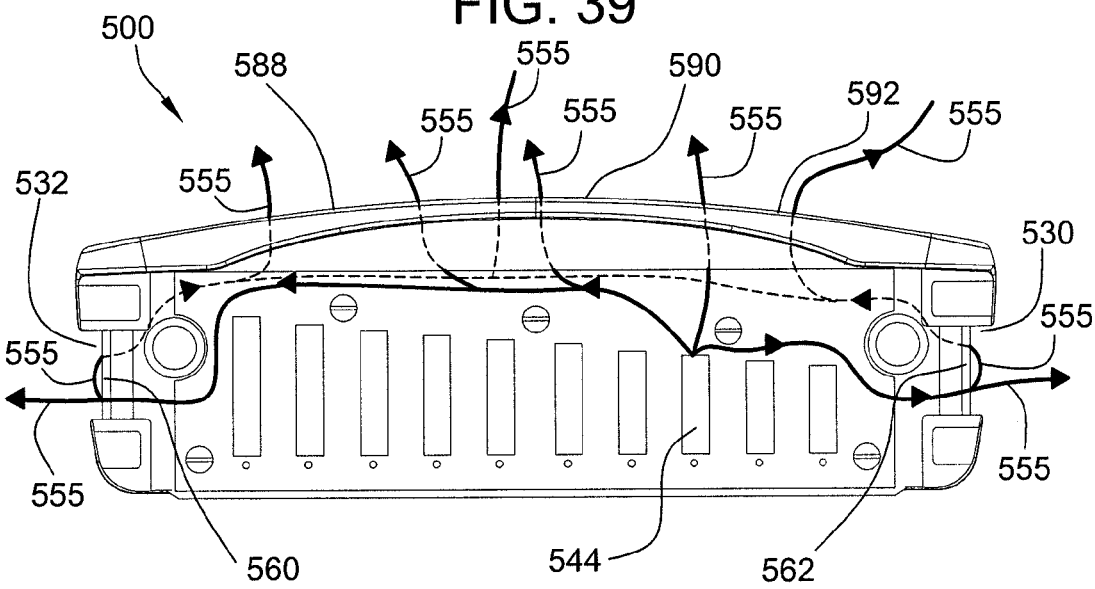
FIG. 39 is a top view with the cover removed to show the air flow when air is blown into the harmonica.
Figure 40:
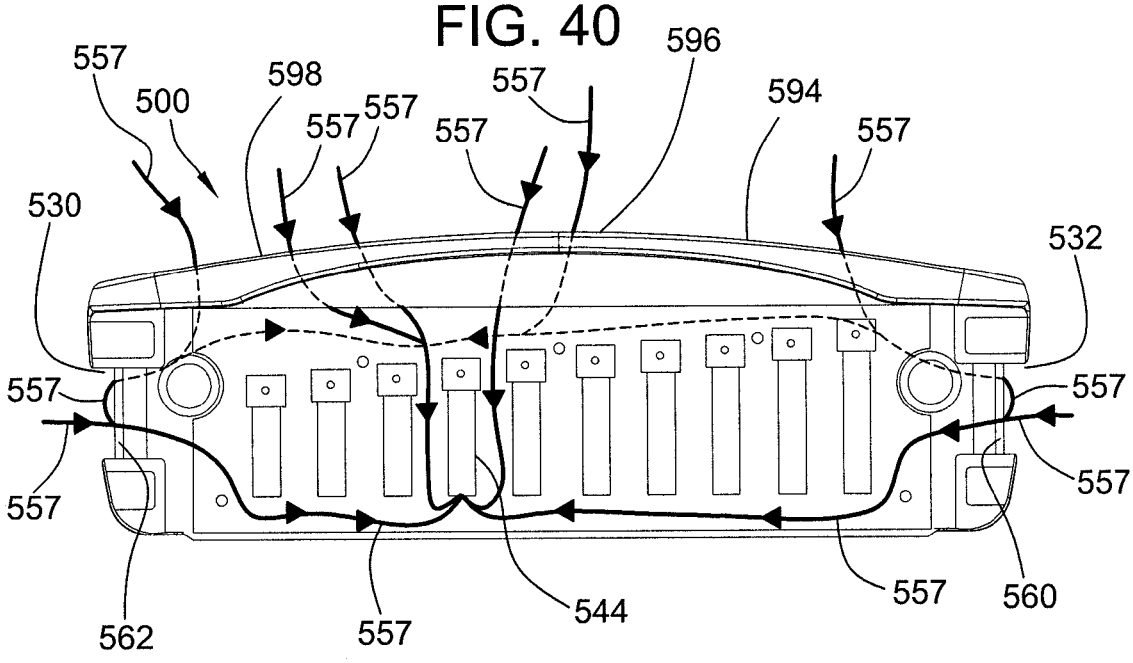
FIG. 40 is a bottom view with the cover removed to show the air flow when air is drawn into the harmonica.

Referring to FIG. 29, the user would play the harmonica 500 by blowing into the slots 552 to make the reeds vibrate or by inhaling and drawing air past the reeds and into the slots. The air exits or enters the harmonica through the openings at the rear of the harmonica and the side vents. For example, referring to FIGS. 37 and 39, when air 555 is blown into the slot 552, the air 555 moves past the reed 544 and vibrates the reed. The air 555 then exits the harmonica through the upper rear openings 588, 590, 592 and the side vents 530, 532. The air 555 may also travel around the sides 560, 562 of the comb and exit through the lower rear openings 594, 596, 598. Referring to FIGS. 38 and 40, when air 557 is drawn into the harmonica, the air 557 may enter the lower rear openings 594, 596, 598 and the side vents 530, 532 and be drawn past the reed 544 and into the slot 552. The air 557 may also enter the upper rear openings 588, 590, 592 and travel around the sides 560, 562 of the comb to be drawn past the reed 544. Thus, the side vents may improve the sound by allowing a greater amount of air to exit or to enter the harmonica as appropriate.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments are described herein. Variations of those embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A harmonica comprising a comb, a cover, a first reed plate, the first reed plate includes first reeds, a second reed plate, the second reed plate includes second reeds, the comb is positioned between the first reed plate and the second reed plate, the cover is attached to the comb with a button, the button is on the comb, the cover includes an opening, the button has a first position and a second position, the button engages the opening in the first position, and the button disengages the opening in the second position.

2. The harmonica in claim 1 wherein the button is on the top of the harmonica.

3. The harmonica in claim 1 wherein the button is on the bottom of the harmonica.

4. The harmonica in claim 1 wherein the button is on the side of the harmonica.

5. A harmonica comprising a comb, a cover, a first reed plate, the first reed plate includes first reeds, a second reed plate, the second reed plate includes second reeds, the comb is positioned between the first reed plate and the second reed plate, the comb includes a first opening, an insert is located in the first opening, the first reed plate has a second opening, the insert has a first width, the second opening has a second width, and the first width is larger than the second width.

6. The harmonica as in claim 5 wherein the insert is tubular.

7. The harmonica as in claim 5 wherein the comb includes a second opening, a second insert is located in the second opening.

8. The harmonica as in claim 5 further comprising a screw, wherein the screw is inserted into the insert.

9. The harmonica as in claim 5 wherein the insert contacts the first reed plate.

10. The harmonica as in claim 5, the insert contacts the first reed plate and the second reed plate.

11. The harmonica as in claim 5 wherein the insert is made of metal.

12. A harmonica comprising a comb, a cover, a first reed plate, the first reed plate includes first reeds, a second reed plate, the second reed plate includes second reeds, the comb is positioned between the first reed plate and the second reed plate, a front opening and a rear opening, the comb includes a first comb side opening, air enters the harmonica at the front opening, a first portion of the air exits the harmonica at the rear opening, a second portion of the air travels through the first comb side opening.

13. The harmonica as in claim 12 further comprising a second rear opening, a portion of the second portion of air exits the second rear opening.

14. The harmonica as in claim 12 further comprising a first cover side opening, air exits through the first cover side opening.

15. The harmonica as in claim 14 further comprising a second cover side opening, the harmonica includes a left side and a right side, the first cover side opening is on the right side, the second cover side opening is on the left side.

16. A harmonica comprising a comb, a cover, a first reed plate, the first reed plate includes first reeds, a second reed plate, the second reed plate includes second reeds, the comb is positioned between the first reed plate and the second reed plate, the comb includes a first upper surface, the first reed plate is mounted on the first upper surface, a first rim extends away from the first upper surface, the comb includes a first lower surface, the second reed plate is mounted on the first lower surface, a second rim extends away from the first lower surface, the cover engages the first rim, the cover engages the second rim.

17. The harmonica as in claim 16 wherein the cover includes a first cover and a second cover, the first cover engages the first rim, the second cover engages the second rim.

18. A harmonica comprising a comb, a cover, a first reed plate, the first reed plate includes first reeds, a second reed plate, the second reed plate includes second reeds, the comb is positioned between the first reed plate and the second reed plate, the comb includes a front portion and a rear portion, the rear portion includes an upper wall, a lower wall, and a first support, the upper wall extends outward away from the front portion, the lower wall extends outward away from the front portion, the first support extends from the upper wall to the lower wall, the first reed plate includes a rear edge, the first support is located beyond the rear edge.

19. The harmonica of claim 18 further comprising a second support which extends from the upper wall to the lower wall.

20. The harmonica of claim 16 wherein the first reed plate includes a rear edge, the first rim is located beyond the rear edge.

* * * * *